US008826565B2

(12) United States Patent
Hahn et al.

(10) Patent No.: US 8,826,565 B2
(45) **Date of Patent: *Sep. 9, 2014**

(54) AUTOMOTIVE PAINT SPRAY AND DRYING BOOTH

(75) Inventors: Paul Hahn, Canton, MI (US); Richard J. Hahn, Northville, MI (US)

(73) Assignee: Hahn Marketing LLC, Taylor, MI (US)

( * ) Notice: Subject to any disclaimer, the term of this patent is extended or adjusted under 35 U.S.C. 154(b) by 223 days.

This patent is subject to a terminal disclaimer.

(21) Appl. No.: 13/523,143

(22) Filed: Jun. 14, 2012

(65) Prior Publication Data

US 2013/0333239 A1 Dec. 19, 2013

(51) Int. Cl.
*F26B 11/02* (2006.01)

(52) U.S. Cl.
USPC ..... 34/666; 118/326

(58) Field of Classification Search
CPC ..... F26B 5/00; F26B 7/00; F26B 9/00; F26B 9/003; F26B 9/06; F26B 9/103; F26B 11/00; F26B 11/02; F26B 11/022; F26B 11/0404; F26B 11/0477; F26B 19/00; F26B 20/00; F26B 2210/12; B05B 15/12; G02C 7/04; G02C 7/021; G02C 7/048; B08B 7/00; B08B 7/002
USPC ..... 34/666; 118/326
See application file for complete search history.

(56) References Cited

U.S. PATENT DOCUMENTS

| | | | | |
|---|---|---|---|---|
| 1,828,609 | A * | 10/1931 | Mahon | 454/51 |
| 2,250,260 | A * | 7/1941 | Fowler | 95/16 |
| 6,287,388 | B1 * | 9/2001 | Hahn | 134/6 |
| 2007/0215042 | A1 * | 9/2007 | Shutic et al. | 118/326 |
| 2008/0184991 | A1 * | 8/2008 | Krupp | 126/99 R |
| 2010/0293909 | A1 * | 11/2010 | Thomason | 55/385.1 |
| 2012/0260521 | A1 * | 10/2012 | Bunnell et al. | 34/666 |
| 2012/0266812 | A1 * | 10/2012 | Iwakiri | 118/326 |
| 2013/0333239 | A1 * | 12/2013 | Hahn et al. | 34/565 |
| 2013/0337733 | A1 * | 12/2013 | Williams | 454/52 |

* cited by examiner

*Primary Examiner* — Steve M Gravini
(74) *Attorney, Agent, or Firm* — Gifford, Krass, Sprinkle, Anderson & Citkowski, P.C.

(57) ABSTRACT

An automotive paint spray and drying booth having a plurality of walls which, together, define a housing with a chamber sufficient in size to contain an automotive vehicle. An air dispenser is positioned within the chamber and the air dispenser includes an outlet positioned to direct air along one or more of the housing walls. A regenerative blower is positioned outside the housing chamber. The blower is connected to an inlet open outside of the housing chamber and includes an outlet which is fluidly connected to the air nozzle.

7 Claims, 4 Drawing Sheets

AUTOMOTIVE PAINT SPRAY AND DRYING BOOTH

BACKGROUND OF THE INVENTION

I. Field of the Invention

The present invention relates generally to drying automotive coatings in paint booths and preparation decks for automotive vehicles.

II. Description of Related Art

Many automotive repair shops, oftentimes called collision shops, maintain an automotive paint spray and drying booth. These booths include a plurality of walls which, together, define a chamber of size sufficient to contain an automotive vehicle.

One or more air dispensers are positioned within the interior chamber of the drying booth housing. These air dispensers are typically connected to the shop supply of pressurized air. Consequently, when the pressurized air is connected fluidly to the nozzle, air flow occurs around the automotive vehicle which not only removes paint particles from the booth, but also serves to dry the paint after application on the vehicle.

One disadvantage of utilizing the shop compressed air as the air flow source for the paint spray and drying booth is that such compressed air contains a relatively highly portion of moisture. While such moisture was acceptable, or at least tolerated, for the previously used solvent based paints, with the newer water based automotive paints and finishes, the humid air from the shop compressed air supply unduly prolongs the drying time for the paint applied to the vehicle.

A still further disadvantage of using shop compressed air to create the air flow in the drying booth is that the release of the pressurized shop air through the air nozzles reduces the overall temperature of the air. The relatively cool air further prolongs the drying time for water based automotive paints and other water based finishes.

Alternatively, the air from the compressor may be heated by external heating means in order to heat the air prior to its release inside the paint spray and drying booth. However, the use of external heaters to heat the compressed air results in increased energy consumption and, accordingly, increased operational cost.

SUMMARY OF THE PRESENT INVENTION

The present invention provides an alternative means of drying automotive paint which overcomes all of the above mentioned disadvantages of the previously known drying systems for paint booths.

In brief, the paint spray and drying booth of the present invention includes a housing having walls together which define a chamber. This chamber, furthermore, is of size sufficient to accommodate at least one automotive vehicle. With an automotive vehicle positioned within the housing chamber, sufficient room is provided around the automotive vehicle to permit a worker to freely move around the vehicle.

At least one, and preferably two or more, air dispensers are positioned within the booth chamber. Each air dispenser preferably includes an elongated opening to expel or release air. Additionally, the opening or outlet from the dispenser is oriented so that exiting air flows along the sides of an automotive vehicle positioned within the booth rather than directly at the booth.

A regenerative blower is positioned outside of the booth chamber. The blower includes an inlet which is open to air outside the booth chamber (that is filtered) and has its outlet fluidly connected by piping to the air dispenser. Consequently, upon activation of the blower, the blower inducts air from outside the paint spray and drying booth while the outlet from the blower is fluidly connected to the air dispenser so that the inducted air is expelled within the interior of the booth in a direction along the sides of the booth.

Other alternative ways such as using shop compressed air to create the air flow within the paint spray and drying booth, the air output from the regenerative blower provides low humid air from the heat it produces. As such, it facilitates the drying of paint and particularly the drying of water based paints.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
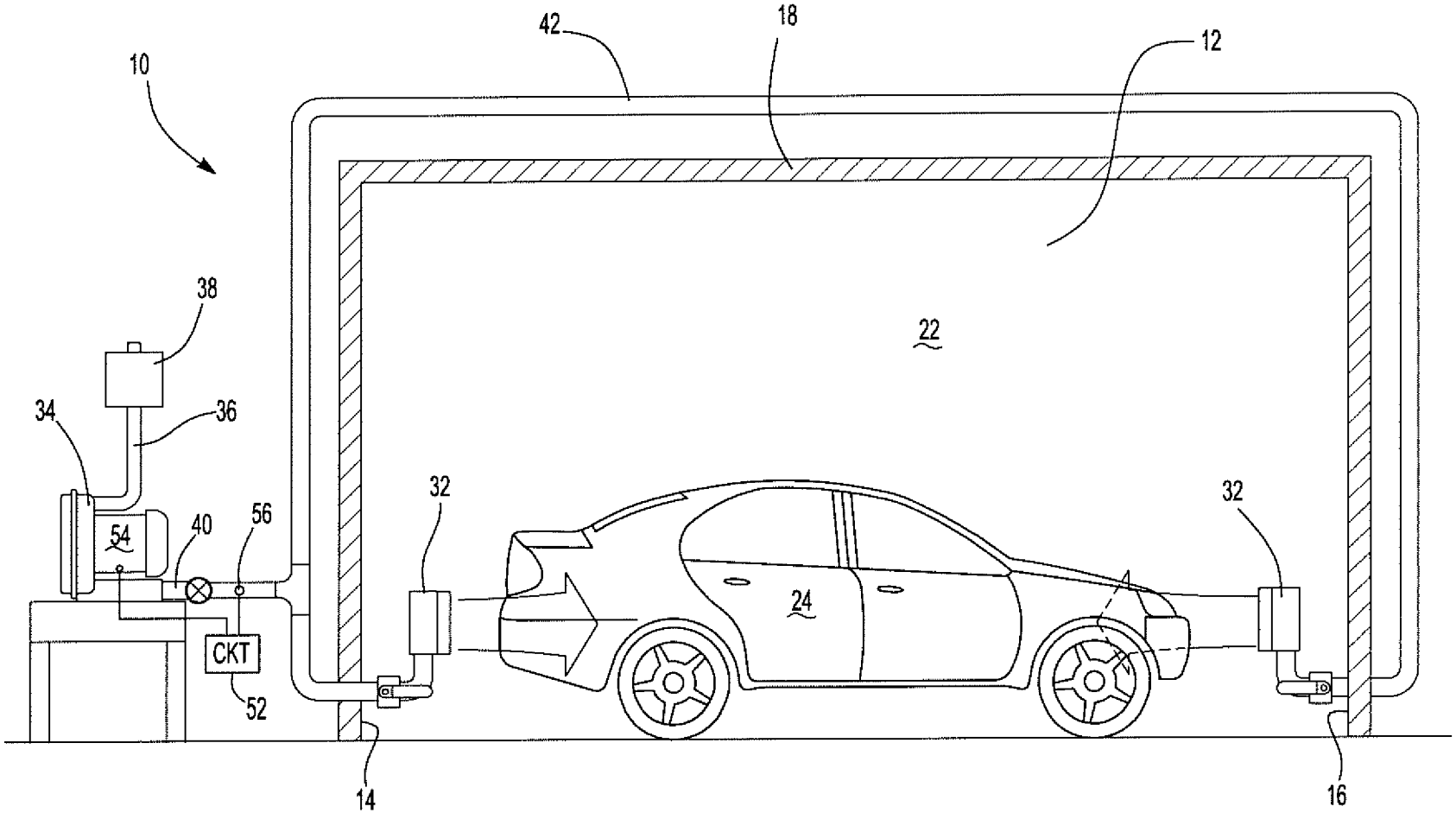
FIG. 1 is a side diagrammatic view of a paint spray and drying booth according to the present invention.
Figure 2:
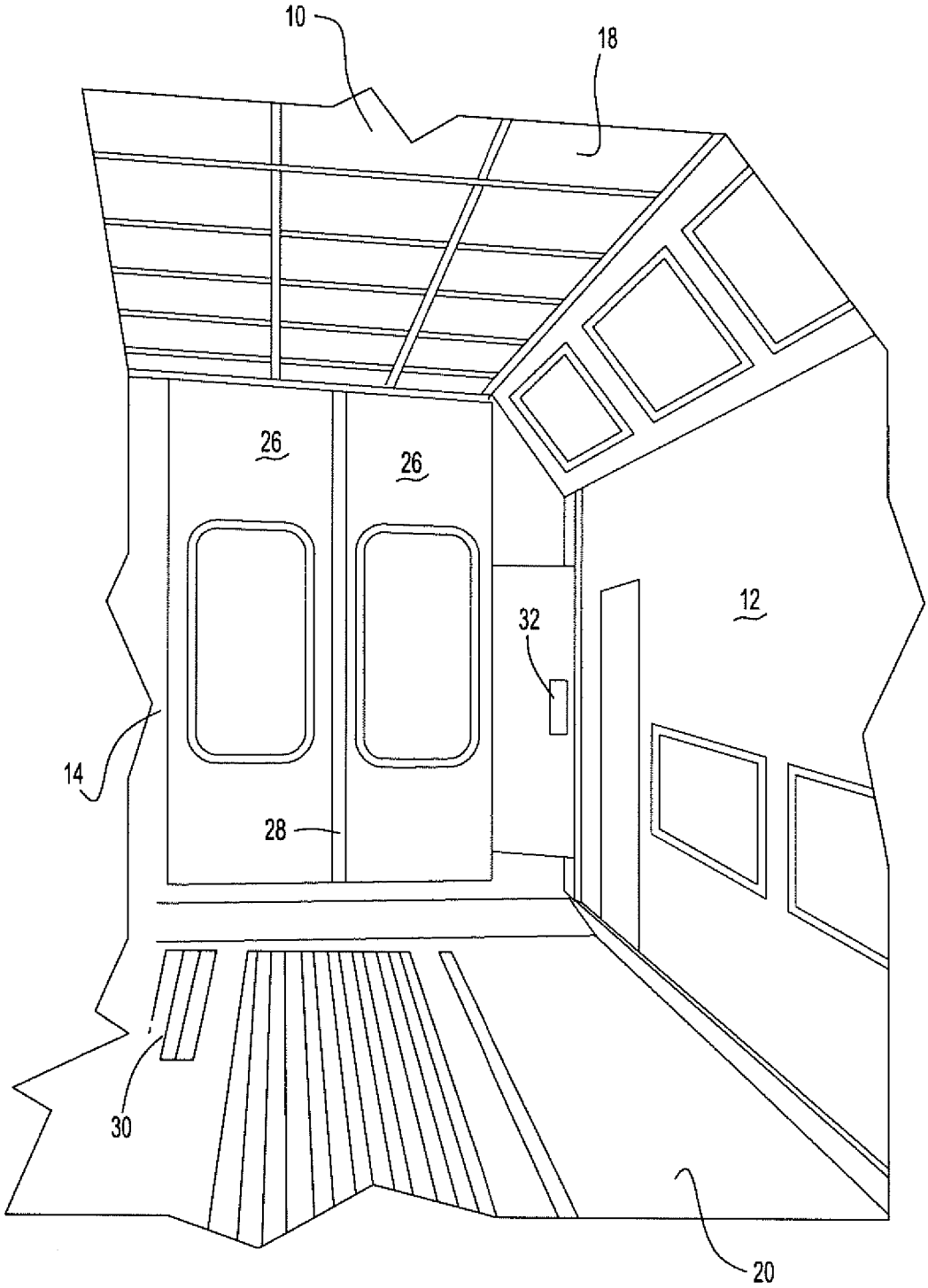
FIG. 2 is a fragmentary elevational view illustrating the interior of the paint spray and drying booth.

With reference first to FIGS. 1 and 2, a preferred embodiment of a paint spray and drying booth 10 in accordance with the present invention is shown. The booth includes a pair of spaced apart side walls 12 (only one shown), two end walls 14 and 16, as well as a top wall 18 and floor 20. Together, the side walls 12, end walls 14 and 16, top wall 18, and floor 20 form a chamber 22 which is of a size sufficient to receive an automotive vehicle 24.

As best shown in FIG. 2, at least one end wall 14 includes access doors 26 to provide access into and out of the interior chamber 22 for the automotive vehicle 24. Preferably, the doors 26 include seals 28 around an outer periphery to minimize the leakage of air around the doors and into the chamber 22.

Still referring to FIG. 2, the floor 20 preferably includes at least one grate 30 which is fluidly connected to an air exhaust. Consequently, air flow into the interior chamber 22 of the booth 10 will eventually flow out through the grate(s) for exhaustion into the atmosphere.

Figure 3:
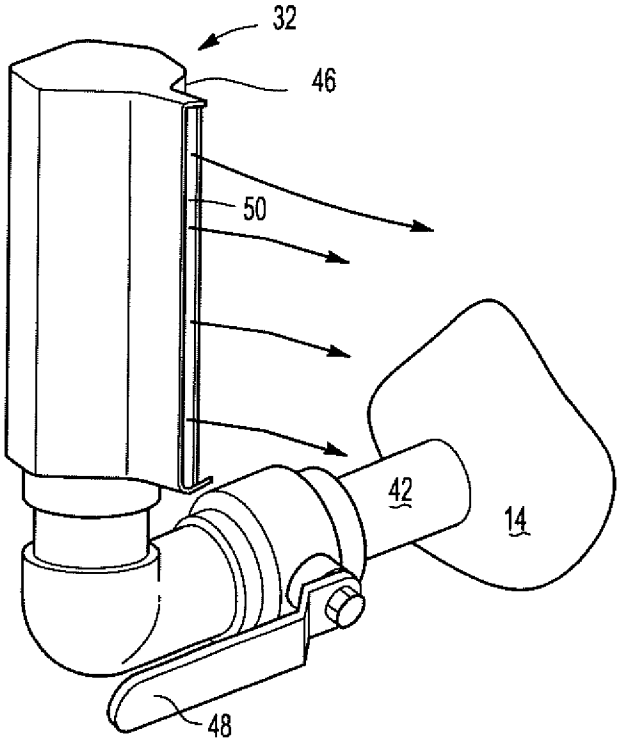
FIG. 3 is an elevational view illustrating an air nozzle.
Figure 5:
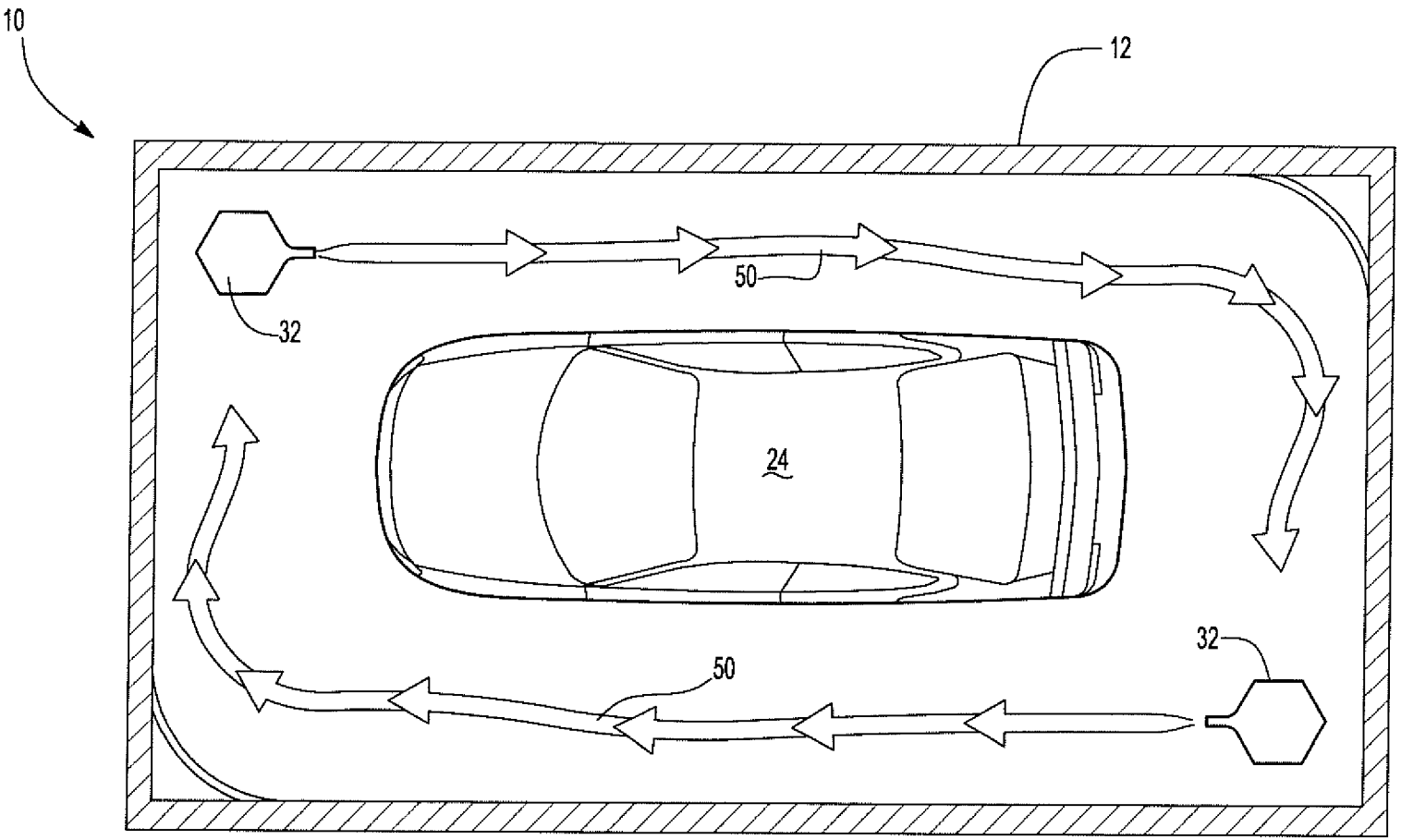
FIG. 5 is a top diagrammatic view illustrating the air flow within the paint spray and drying booth using the present invention.

With reference now to FIGS. 1-3, at least one, and preferably two air nozzles 32 are positioned within the interior chamber 22 of the booth 10. Preferably, one air nozzle 32 is positioned in one corner of the booth 10 while the other air nozzle 32 is positioned in the diagonally opposite corner. Each air nozzle 32, furthermore, is positioned a few feet above the ground so that the air nozzle 32 would be aligned with at least a portion of the body of the vehicle 24.

Figure 4:
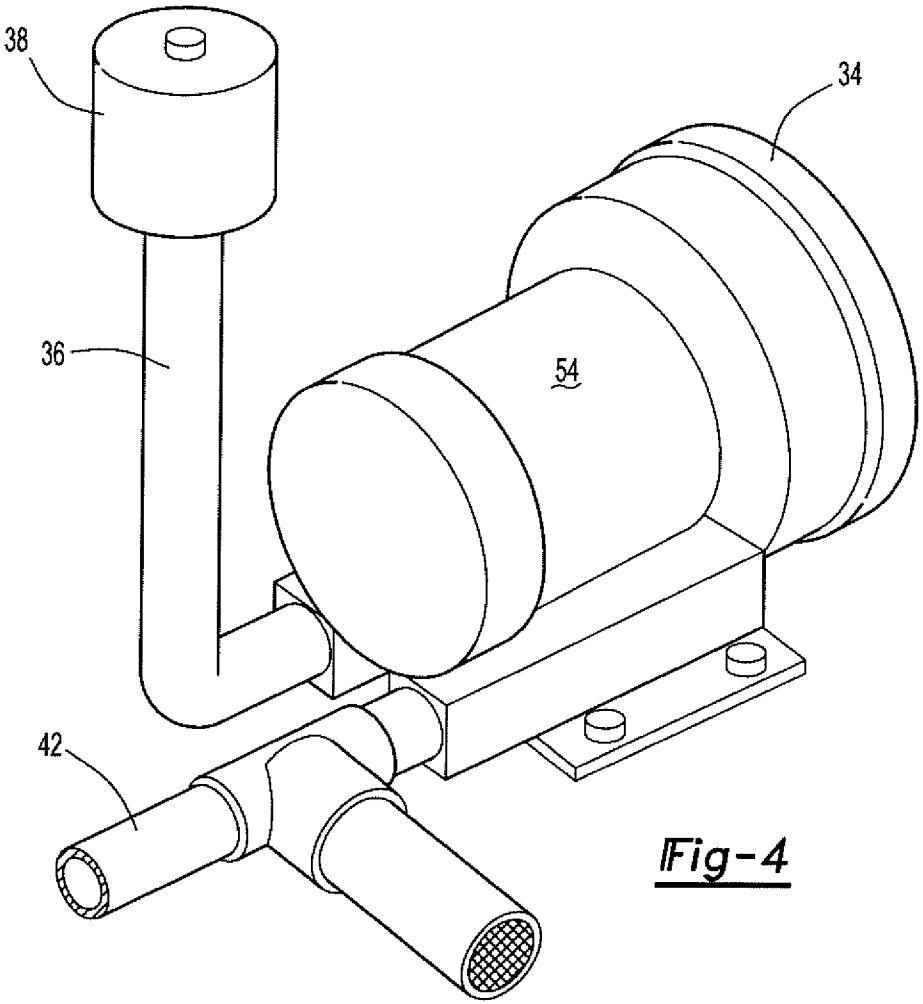
FIG. 4 is an elevational view of a regenerative blower.

With reference now to FIGS. 1, 3 and 4, a regenerative blower 34 has an inlet 36 open exteriorly of the booth chamber 22. An air filter 38, furthermore, is fluidly connected in series with the inlet 36 so that air inducted by the regenerative blower 34 first passes through the filter 38 to remove any contaminants or particles that may be entrained within the inducted air.

The regenerative blower 34 includes an outlet 40 which is fluidly connected by piping 42 to the air nozzles 32 within the interior chamber 22 of the booth 10.

The regenerative blower 34 is preferably powered by an electric motor so that the air flow produced by the blower 34 varies as a function of the engine speed of the motor for the blower 34. Consequently, the air flow into the booth chamber 22 may be varied depending upon the needs of the particular operation. For example, when the booth 10 is used in the spray cycle, relatively high air flow is desired to dry water-borne or solvent based coatings. Conversely, a lower air flow through the booth bake cycle 22 would be desired during a drying cycle or bake cycle, which will create a convection oven effect during the drying process and reduce bake cycle time.

With reference now to FIG. 3, the air nozzle 32 is there shown in greater detail and includes a nozzle housing 46 constructed of any suitable rigid material, such as metal. The housing 46 includes an interior nozzle chamber that is fluidly connected to the piping 42 to the regenerative blower 34. A valve 48 is also preferably connected in series between the piping 42 and the nozzle 32 to adjust the air flow through the nozzle 32.

An elongated slit 50 is formed by the air dispenser housing 42 to establish fluid communication from the interior chamber and exteriorly of the nozzle housing 46. Since the dispenser housing 50 is narrow, the dispenser 32 is capable of producing high air speeds with only relatively low air pressure. Furthermore, the width of the opening is preset for air speed.

With reference now to FIGS. 2-4, the air nozzles 32 are oriented so that the slit 60 expels air in a direction generally parallel to the side walls 12 of the booth 10 as indicated by arrows 50 in FIG. 4. Consequently, the orientation of the air nozzles 32 ensures that air flows around the vehicle 24. Since the air flow from the air nozzles 32 does not directly impinge upon the vehicle 24, the vehicle 24 is protected from air damage that might otherwise be caused from high air speeds impinging upon the newly painted vehicle 24.

With reference again to FIG. 1, a motor control circuit 52 is electrically connected to and controls the speed or RPM of a motor 54 used to rotatably drive the regenerative fan in the blower 34. A pressure sensor 56 in the outlet piping 42 from the blower 34 forms an input signal to the circuit 52 so that the speed of the motor 54 may be controlled as a function of the air pressure in the piping 42 to the air nozzles 32. Such control of the motor speed 54 would be desirable for different operations, such as paint spraying versus paint drying, in the booth 10.

The use of the regenerative blower 34, particularly with the motor speed control or ball valve methods, provides many advantages over the previously known paint booth drying systems in which the air supply was provided by the shop compressed air supply. In particular, since the regenerative blower 34 does not compress the air significantly, at least as compared to a shop compressor, less moisture is entrained within the air flow from the blower 34. In addition, since the regenerative air subjects the ambient air to a slight compression, the air becomes heated which facilitates the drying of the paint on the vehicle 24, and especially water based paints. This is in sharp contrast to the compressor shop air which, by expansion of the air, results in a temperature drop for the air.

Furthermore, the blower 34 may be either installed in a fixed location or may be portable. If portable, the blower is preferably mounted on a wheeled table as is powered by 120 VAC.

Having described our invention, many modifications thereto will become apparent to those skilled in the art to which it pertains without deviation from the spirit of the invention as defined by the scope of the appended claims.

We claim:

1. An automotive paint spray and drying booth comprising:

a housing having walls which define a chamber sufficient in size to contain an automotive vehicle, an air dispenser in said chamber, said air dispenser having an outlet positioned to direct air along at least one of said housing walls, a regenerative blower positioned outside said housing chamber, said blower having an inlet open outside said housing chamber and an outlet fluidly connected to said air dispenser.

2. The automotive paint spray and drying booth as defined in claim 1 and comprising an access door for said housing.

3. The automotive paint spray and drying booth as defined in claim 1 wherein said air dispenser comprises a dispenser body having an interior cavity fluidly connected to said blower outlet, and said dispenser body having an elongated opening which extends through said dispenser body to said interior cavity, said elongated opening forming the dispenser outlet.

4. The automotive paint spray and drying booth as defined in claim 3 wherein said air dispenser is oriented to direct air flow along the sides of the booth.

5. The automotive paint spray and drying booth as defined in claim 1 and comprising a control circuit which, in response to at least one input signal, varies the speed of said blower.

6. The automotive paint spray and drying booth as defined in claim 5 wherein said sensor comprises a pressure sensor mounted in the air flow path for said blower.

7. The automotive paint spray and drying booth as defined in claim 1 and comprising two air dispensers, said air dispensers being positioned adjacent opposite corners of the vehicle and positioned to direct air longitudinally along opposite sides of the vehicle and in opposite directions.

* * * * *